US005335374A

United States Patent [19]

Wilk et al.

[11] Patent Number: 5,335,374

[45] Date of Patent: Aug. 9, 1994

[54] PLUNGER ASSEMBLY AND ASSOCIATED METHOD

[76] Inventors: Marilyn M. Wilk; Peter J. Wilk, both of 185 W. End Ave., New York, N.Y. 10023

[21] Appl. No.: 158,958

[22] Filed: Nov. 29, 1993

Related U.S. Application Data

[60] Continuation-in-part of Ser. No. 864,601, Apr. 7, 1992, which is a division of Ser. No. 505,064, Apr. 5, 1990, Pat. No. 5,114,006.

[51] Int. Cl.[5] ..... E03D 11/00

[52] U.S. Cl. ..... 4/255.11

[58] Field of Search ..... 4/255.01-255.12

[56] References Cited

U.S. PATENT DOCUMENTS

| | | | |
|---|---|---|---|
| 576,507 | 2/1897 | McClelland | 4/255.01 X |
| 952,495 | 3/1910 | Austin | 4/255.11 X |
| 1,852,071 | 4/1932 | Becker | 4/255.11 |
| 3,644,943 | 2/1972 | Parodifu et al. | 4/255.11 |
| 4,458,368 | 7/1984 | Webb | 4/255.11 |

*Primary Examiner*—Charles E. Phillips

*Attorney, Agent, or Firm*—R. Neil Sudol; Henry D. Coleman

[57] ABSTRACT

A household implement comprises a cup-shaped plunger member contactable with a household surface and a collapsible handle attached to the plunger member. The handle has an outer tubular handle part and an inner tubular handle part telescopingly inserted therein. One end of the inner tubular handle part is fixed to the plunger member, while an opposite end of the inner tubular handle part is disposed inside a first end of the outer tubular handle part. The first end of the outer tubular handle part is provided with an aperture. The household implement further comprises a hollow casing member attached to the outer tubular handle part at the first end thereof. The hollow casing member is larger than the plunger member, so that the casing member can substantially surround the plunger member upon movement of the outer tubular handle part over the first tubular handle part towards the plunger member. The household implement also comprises a locking mechanism for locking the collapsible handle in an extended, operative configuration. The locking mechanism includes at least one spring-loaded latch element provided on the inner tubular handle part proximately to the end thereof opposite the plunger member. The spring-loaded latch element is spaced from the plunger member and is insertable through the aperture in the outer tubular handle part to lock the handle parts to one another in the extended, operative configuration of the implement.

12 Claims, 9 Drawing Sheets 214
226
216
218
224
222
220

226
216
228
224
218
214
222
220

238
230
242
232
234
244
240
236

240
244
230
238
232
234
236

PLUNGER ASSEMBLY AND ASSOCIATED METHOD

CROSS-REFERENCE TO RELATED APPLICATION

, This application is a continuation in part of U.S. patent application Ser. No. 07/864,601 filed Apr. 7, 1992 as a divisional of U.S. patent application Ser. No. 07/505,064 filed Apr. 5, 1990, now U.S. Pat. No. 5,114,006.

BACKGROUND OF THE INVENTION

This invention relates to a tool assembly. More particularly, this invention relates to an assembly for a household implement such as a bathroom plunger. This invention also relates to a method for using a plunger.

Most households have at least one bathroom plunger for removing blockages in drains. Frequently, particularly in those houses having limited storage space or in those houses having pronounced drainage difficulties, plungers sit in open view, beneath the sink or beside the bathtub. Generally, because of their functional design, plungers are not especially pleasant to view. Accordingly, it would be useful to enclose the plunger in an appropriately sized housing, by which means the plunger would still remain easily accessible for immediate use in case of emergency.

Plungers are also unsanitary implements, inasmuch as little care is generally taken to clean them. Such implements are therefore a source of disease bacteria for young children who inhabit floor spaces and are not adverse to intimate tactile association with whatever objects are on the floor.

OBJECTS OF THE INVENTION

An object of the present invention is to provide a plunger device with a housing for hiding the plunger from view.

Another, more particular object of the present invention is to provide such a plunger device with a housing having any of a variety of decorative shapes.

Another object of the present invention is to provide a tool assembly, for use as a household implement such as a bathroom plunger, wherein a housing or casing also serves as a holder.

Yet another object of the present invention is to provide such a tool assembly which serves to maintain sanitary conditions and to prevent young children from playing with household implements which may carry infectious bacteria or viruses.

SUMMARY OF THE INVENTION

A household implement comprises, in accordance with the present invention, a cup-shaped plunger member contactable with a household surface and a collapsible handle attached to the plunger member. The handle has an outer tubular handle part and an inner tubular handle part telescopingly inserted therein. One end of the inner tubular handle part is fixed to the plunger member, while an opposite end of the inner tubular handle part is disposed inside a first end of the outer tubular handle part. The first end of the outer tubular handle part is provided with an aperture. The household implement further comprises a hollow casing member attached to the outer tubular handle part at the first end thereof. The hollow casing member is larger than the plunger member, so that the casing member can substantially surround the plunger member upon movement of the outer tubular handle part over the first tubular handle part towards the plunger member. The household implement also comprises a locking mechanism for locking the collapsible handle in an extended, operative configuration. The locking mechanism includes at least one spring-loaded latch element provided on the inner tubular handle part proximately to the end thereof opposite the plunger member. The spring-loaded latch element is spaced from the plunger member and is insertable through the aperture in the outer tubular handle part to lock the handle parts to one another in the extended, operative configuration of the implement.

According to another feature of the present invention, at least one additional aperture is provided in the outer tubular handle part at a second end thereof opposite the first end. The spring-loaded latch element is insertable through the additional aperture upon a collapsing of the outer tubular handle part over the inner tubular handle part and a covering of the plunger member with the casing member. The additional aperture in the outer tubular handle part thus cooperates with the spring-loaded latch element to lock the handle in a collapsed storage configuration.

A household implement comprises, in accordance with a more general conceptualization of the present invention, a cup-shaped plunger member contactable with a household surface, a first tubular handle part connected at one end to the plunger member, and a second tubular handle part, the first tubular handle part being matingly inserted in a first end of the second tubular handle part. A hollow casing member is attached to the second tubular handle part at the first end thereof. The hollow casing member is larger than the plunger member, whereby the casing member substantially surrounds the plunger member upon movement of the outer tubular handle part over the first tubular handle part towards the plunger member. A locking mechanism is connected to at least one of the handle parts for locking the handle parts to one another in an extended, operative configuration of the implement.

As discussed above, the locking mechanism includes an aperture in a side wall of the second tubular handle part spaced from the first end. The locking mechanism further includes, one the first tubular handle part, at least one spring-loaded latch element insertable through the aperture in the extended, operative configuration of the implement.

A method for unstopping a household drain utilizes a household implement having a plunger member with a telescoping handle attached thereto, an inner tubular handle part of the telescoping handle being slidably inserted into an outer tubular handle part of the telescoping handle in a storage configuration of the implement. The method includes the steps of (a) removing the implement from storage, (b) shifting the inner tubular handle part out of the outer tubular handle part upon removal of the implement from storage, (c) locking the handle parts to one another in an extended configuration of the handle upon shifting of the inner tubular handle part relative to the outer tubular handle part, (d) manipulating the implement via the telescoping handle to unstop a drain, (e) releasing the inner tubular handle drain, and (f) moving the inner tubular handle part back into the outer tubular handle part upon releasing of the inner tubular handle part from the outer tubular handle part.

According to a further feature of the present invention, the locking of the handle parts includes the step of inserting a latch element in one of the handle parts through an aperture in the other handle part. The latch element may be spring loaded, whereby the releasing of the handle parts includes the step of pressing the latch element through the aperture in the outer handle part in opposition to a biasing spring force.

According to an additional feature of the present invention, the method includes the step of also locking the inner tubular handle part to the outer tubular handle part upon reinsertion of the inner tubular handle part back into the outer tubular handle part to arrive again at the storage configuration of the implement. This additional locking step may include the step of inserting a latch element in one of the handle parts through an aperture in the other handle part.

According to yet another feature of the present invention, where the inner tubular handle part is connected to the plunger member and the outer tubular handle part is provided with a hollow casing member which covers the plunger member in the storage configuration, the shifting of the inner tubular handle part out of the outer tubular handle part upon removal of the implement from storage includes the step of removing the casing member from around the plunger member, thereby uncovering the plunger member by virtue solely of the shifting of the tubular handle parts relative to one another.

Thus, a method for unstopping a household drain utilizing this feature of the present invention, comprises the steps of (i) lifting the implement from a horizontal surface by grasping the outer tubular handle part, (ii) shifting the inner tubular handle part out of the outer tubular handle part upon lifting of the implement from the horizontal storage, (iii) locking the tubular handle parts to one another in an extended configuration of the handle parts so that the casing member is spaced from the plunger member upon shifting of the inner tubular handle part relative to the outer tubular handle part, (iv) manipulating the implement via the telescoping handle to unstop a drain, (v) releasing the inner tubular handle part from the outer tubular handle part upon unstopping of the drain, (vi) moving the inner tubular handle part back into the outer tubular handle part so that the casing member surrounds the plunger member upon releasing of the handle parts, and (vii) replacing the implement so that the plunger member is in contact with a floor surface and surrounded by the casing member.

A tool assembly in accordance with the present invention, when used as a plunger or toilet brush design, is also useful to maintain sanitary conditions and to prevent young children from playing with such implements. A locking device may be provided on the housing or casing for purposes of denying access to the implements to young children.

DETAILED DESCRIPTION

Figure 1:
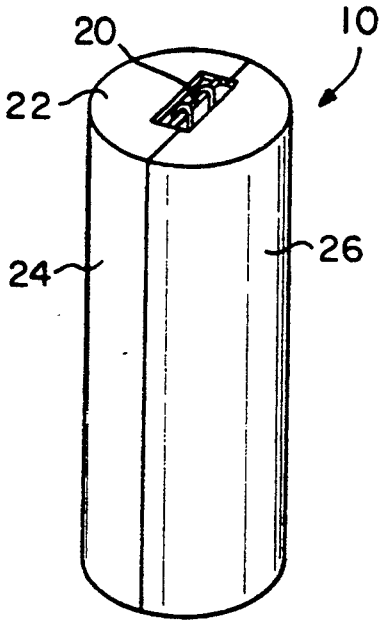
FIG. 1 is a top front perspective view of a plunger and casing combination, showing the casing in a closed configuration.
Figure 2:
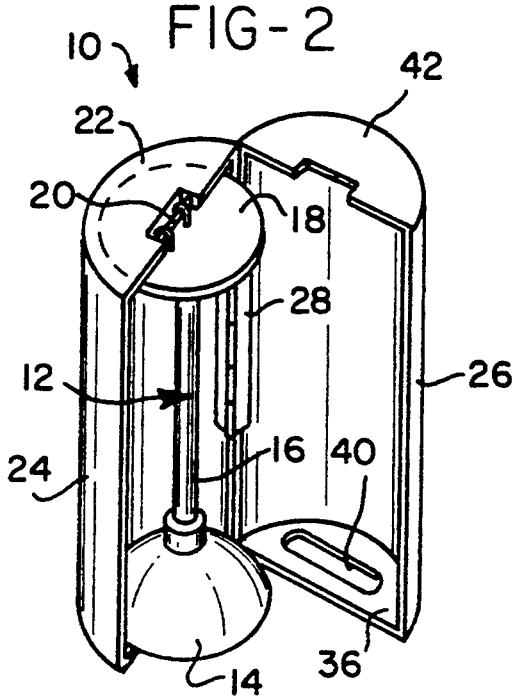
FIG. 2 is a perspective view of the plunger and casing combination of FIG. 1, showing the casing of that drawing figure in an opened configuration and a plunger hanging inside a casing member.
Figure 3:
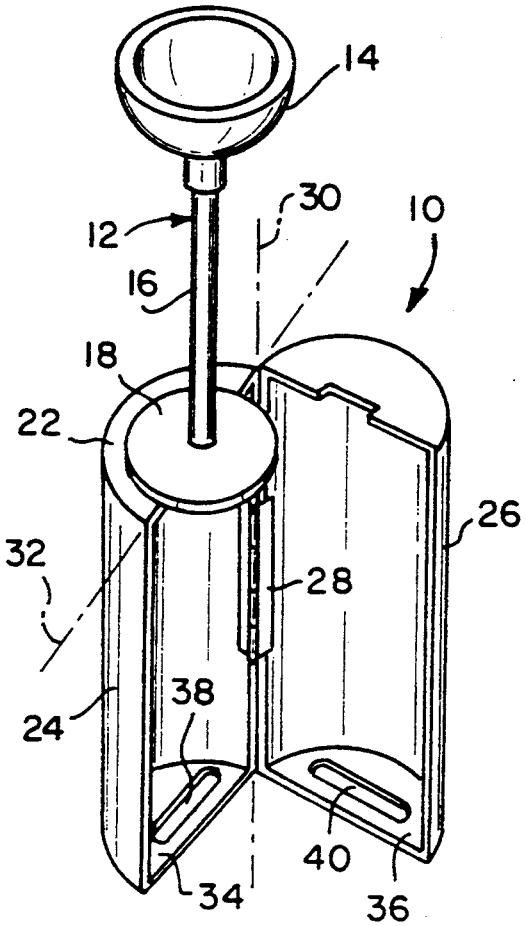
FIG. 3 is a perspective view similar to FIG. 2, showing the casing opened and the plunger in a raised position above the casing.

As illustrated in FIGS. 1–4, a household implement 10 comprises a tool member 12 in the form of a plunger having a plunger head 14 (the operative portion of the plunger) and an elongate extension or handle portion 16. At an upper end, handle portion 16 is provided with a circular flange 18 and is pivotably attached at a rotatable joint 20 to a substantially D-shaped end wall 22 of a semicylindrical casing member 24. Another semicylindrical casing member 26 of a casing 27 is pivotably connected by a hinge 28 to casing member 24 along a longitudinal pivot axis 30. Pivot axis 30 extends perpendicularly to a transverse pivot axis 32 about which plunger member 12 rotates with respect to casing member 24.

Each casing member 24 and 26 has a D-shaped end wall 34 and 36 opposite rotatable joint 20, the end wall being provided with a respective elongate oval aperture 38 and 40, whereby casing members 24 and 26 may be grasped by a user. Accordingly, upon the opening of casing members 24 and 26 by pivoting them relative to one another about axis 30 (compare FIGS. 1 and 2), the swinging of plunger member 12 from a storage position inside casing member 24 to a use position shown in FIGS. 3 and 4, and a subsequent closing of the casing members 24 and 26, the plunger and casing combination is ready for use.

Figure 4:
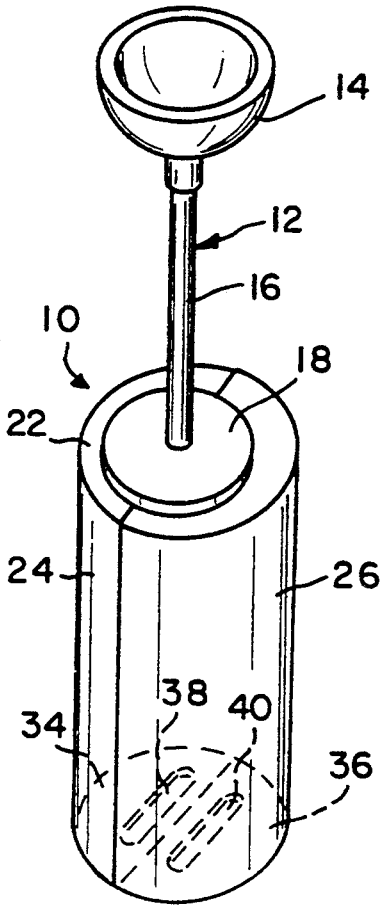
FIG. 4 is a perspective view similar to FIGS. 1–3, showing the casing in a closed configuration and the plunger in an operative or use position outside the casing.
Figure 5:
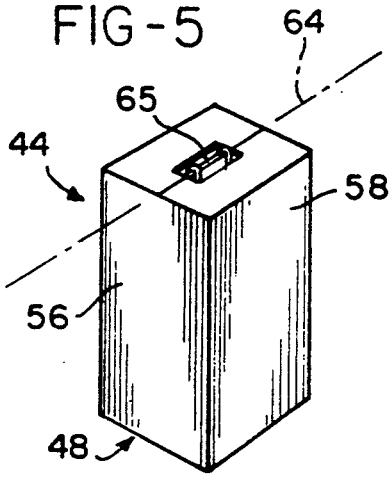
FIG. 5 is a perspective view, similar to FIG. 1 of another plunger and casing combination, with the casing in a closed, storage configuration.
Figure 6:
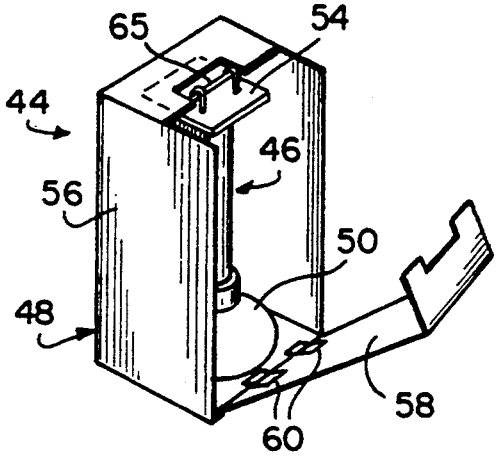
FIG. 6 is a perspective view, similar to FIG. 2, of the plunger and casing combination of FIG. 5, showing the casing of FIG. 5 in an opened configuration and a plunger hanging inside a casing member.
Figure 7:
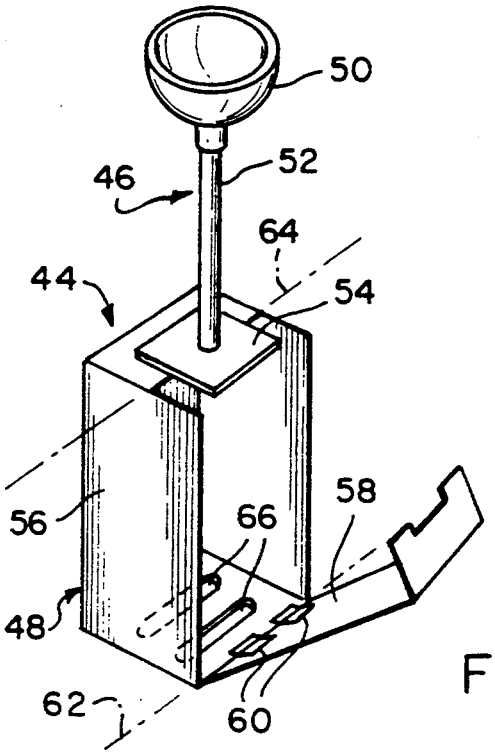
FIG. 7 is a perspective view, similar to FIG. 3, of the plunger and casing combination of FIGS. 5 and 6, showing the casing opened and the plunger in a raised position above the casing.
Figure 8:
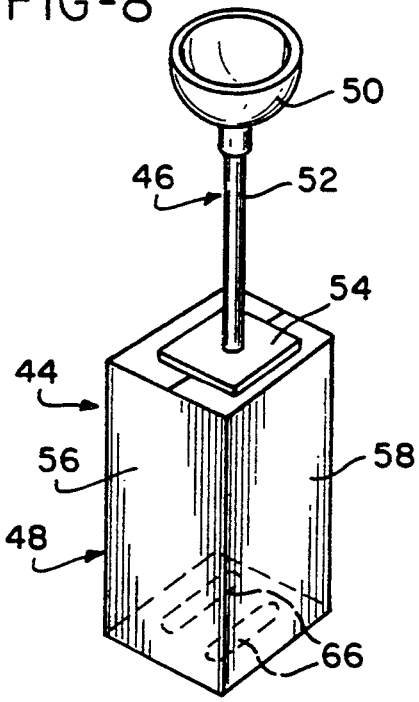
FIG. 8 is a perspective view, similar to FIG. 4, of the plunger and casing combination of FIGS. 5–7, showing the casing in a closed configuration and the plunger in an operative or use position outside the casing.

It is to be noted that flange 18 rests against D-shaped end walls 22 and 42 in the operative configuration of FIG. 4, whereby plunger member 12 is locked into a substantially colinear or coaxial position with respect to casing 27.

As depicted in FIGS. 5–8, another household tool assembly or implement 44 comprises a plunger member 46 and a casing or housing 48. Plunger member 46 includes an operative head portion 50 and an elongate handle portion 52 provided at an end opposite head portion 50 with a rectangular flange 54. Housing 48 includes a main housing component 56 and a cross-sectionally L-shaped door 58 swingably linked to the main housing component by a pair of hinge elements 60. L-shaped door 58 pivots about an axis 62 oriented parallel to another axis 64 about which plunger member 46 rotates with respect to housing component 56. Plunger member 46 is rotatably connected to housing component 56 via a hinge 65. An end wall of housing component 56 is provided with a pair of elongate oval openings 66 for enabling a grasping of housing 48 by a user.

Figure 9:
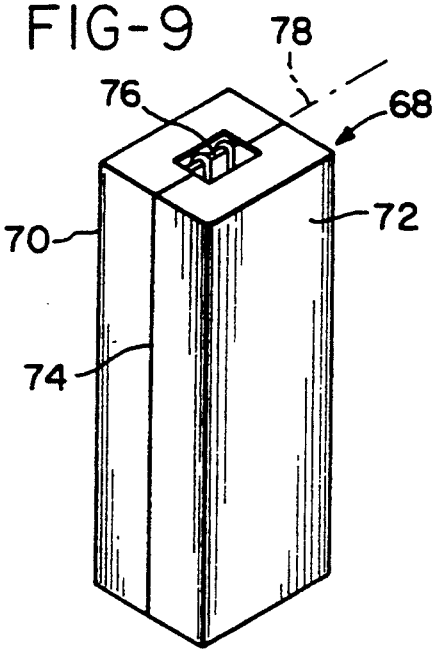
FIGS. 9–12 are perspective views of four casing shapes usable as alternatives to a cylindrical shape shown in FIG. 1.

FIG. 9 shows a casing 68 for use in the plunger and casing combination of FIGS. 1–4. Casing 68 is prismatic, rather than cylindrical, and has two casing halves 70 and 72 pivotably connected to one another along a longitudinally extending joint 74. A plunger (not shown) is rotatably coupled to casing half 70 by a swinging connector 76, whereby the plunger pivots relative to casing half 70 about a transverse axis 78.

Figure 10:
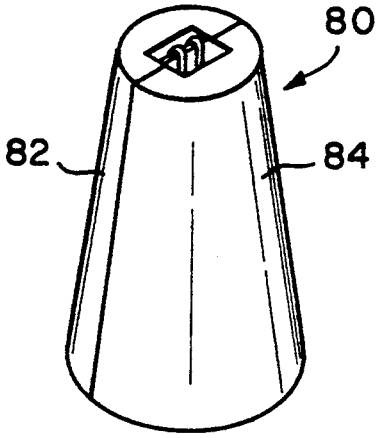
Figure 11:
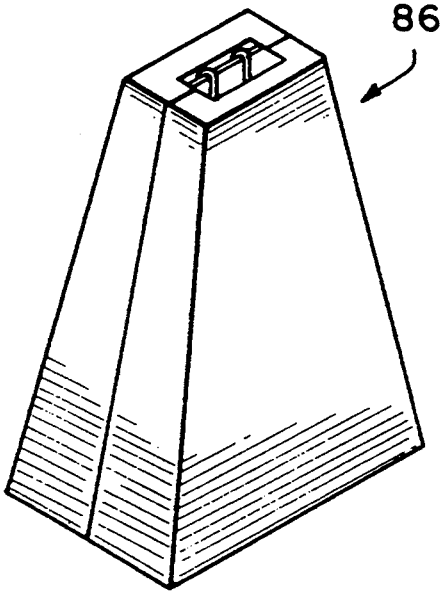
Figure 12:
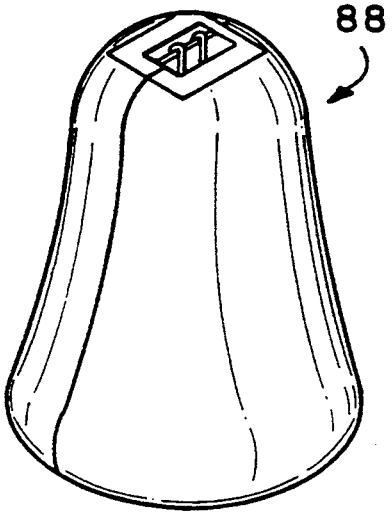
Figure 13:
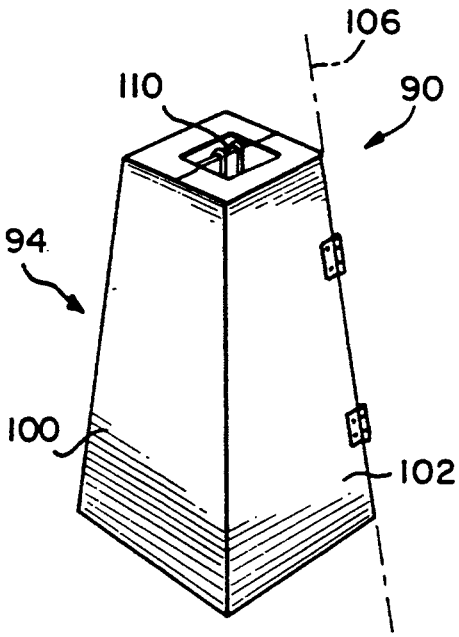
FIG. 13 is a perspective view, similar to FIG. 1 of another plunger and casing combination, with the casing in a closed, storage configuration.
Figure 14:
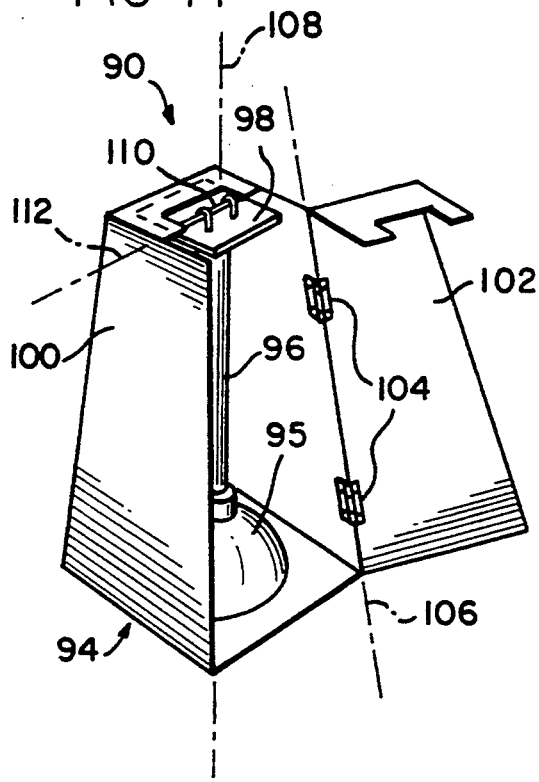
FIG. 14 is a perspective view, similar to FIG. 2, of the plunger and casing combination of FIG. 13, showing the casing of FIG. 13 in an opened configuration and a plunger hanging inside a casing member.
Figure 15:
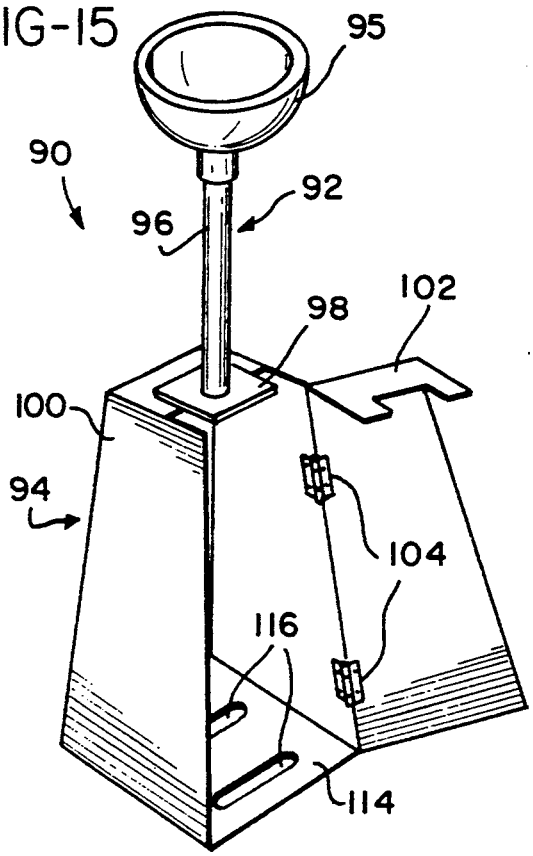
FIG. 15 is a perspective view, similar to FIG. 3, of the plunger and casing combination of FIGS. 13 and 14, showing the casing opened and the plunger in a raised position above the casing.
Figure 16:
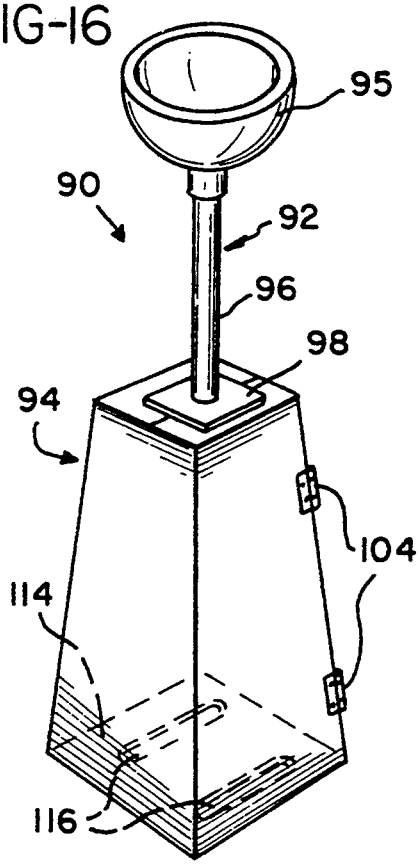
FIG. 16 is a perspective view, similar to FIG. 4, of the plunger and casing combination of FIGS. 13–15, showing the casing in a closed configuration and the plunger in an operative or use position outside the casing.

FIG. 10 illustrates a frustoconical housing 80 having two casing halves 82 and 84, while FIG. 11 shows a frustopyramidal casing 86. A bell-shaped casing 88 is depicted in FIG. 12. The plunger casings 80, 86 and 88 are all provided with hand grips for facilitating a manipulation of the respective plunger and casing combination by a user.

Yet another plunger and casing combination is shown in FIGS. 13–16. A household tool assembly or implement 90 comprises a plunger member 92 and a casing or housing 94. Plunger member 92 includes a substantially semispherical rubber head 94 and an elongate handle portion 96 provided at an end opposite the head portion with a rectangular flange 98. Housing 94 includes a main housing component 100 and a cross-sectionally L-shaped door 102 swingably linked to the main housing component by a pair of hinge elements 104. L-shaped door 102 pivots about an axis 106 oriented at an angle with respect to a longitudinal axis 108 of housing 94. Plunger member 92 rotates with respect to housing component 100 by virtue of a hinge 110 defining an axis of rotation 112. An end wall 114 of housing component 100 is provided with a pair of elongate oval openings 116 for enabling a grasping of housing 94 by a user. As described hereinabove, flange 98 serves to stabilize plunger member 92 with respect to housing 94 in the operative configuration of FIG. 16.

Figure 17:
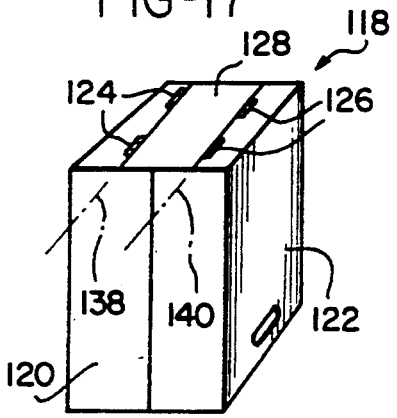
FIG. 17 is a top, side perspective view of yet another plunger and casing combination, showing a closed casing.
Figure 18:
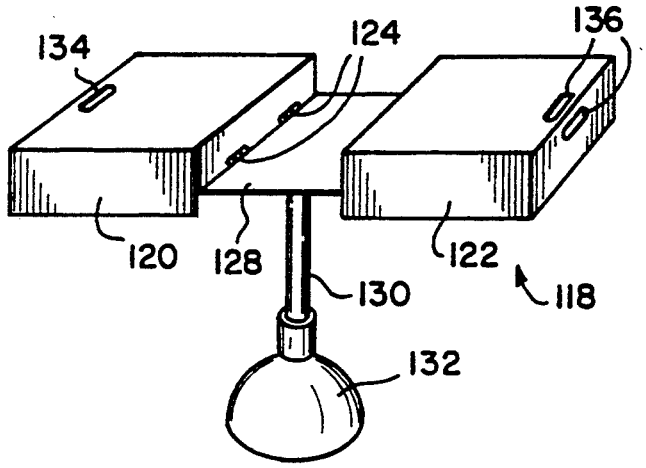
FIG. 18 is a top perspective view of the plunger and casing combination of FIG. 17 with a pair of partially raised or pivoted casing members.
Figure 19:
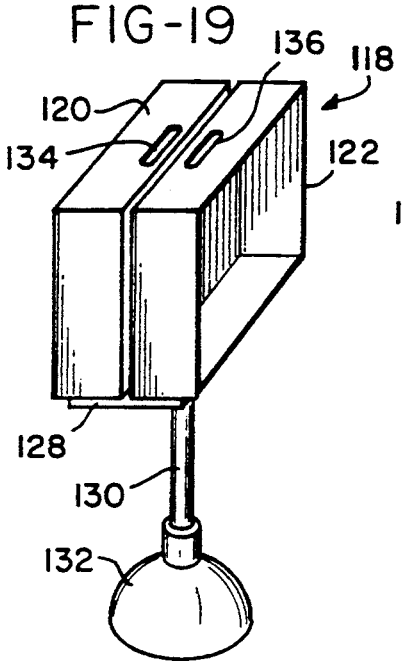
FIG. 19 is a top perspective view of the plunger and casing combination of FIGS. 17 and 18, showing the casing members in a fully raised, operative configuration.

As shown in FIGS. 17–19, another plunger and casing assembly 118 includes a pair of essentially identical box-shaped casing halves 120 and 122 each pivotably coupled by a respective pair of hinges 124 and 126 to a rectangular plate 128 in turn fastened to the end of a plunger handle member 130 opposite a cup-shaped rubber plunger element 132. Each of the box-shaped casing halves 120 and 122 has an open side which faces outwardly in the fully opened configuration of FIG. 19 and inwardly in the closed configuration of FIG. 17. Each casing half 120 and 122 is provided with a pair of elongate essentially oval holes 134 and 136 which enable a user to grib the assembly in its fully opened, operative configuration (FIG. 19).

In the embodiment of FIGS. 17–19, casing halves 120 and 122 are pivotable relative to one another and relative to plunger plate 128 about respective axes 138 and 140. Plate 128 cooperates with casing halves 120 and 122 to fix the plunger element relative to the casing in the operative configuration.

Figure 21:
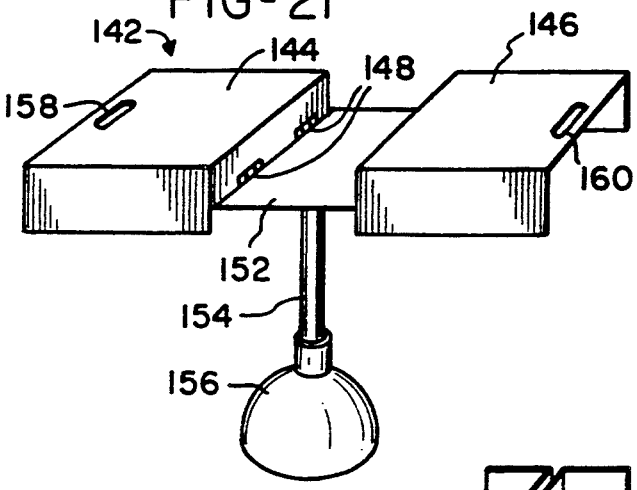
FIG. 21 is a top perspective view of the plunger and casing combination of FIG. 20 with a pair of partially raised or pivoted casing members.
Figure 20:
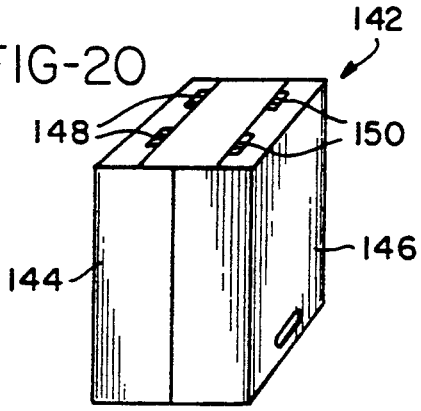
FIG. 20 is a top, side perspective view of yet another plunger and casing combination, showing a closed casing.
Figure 22:
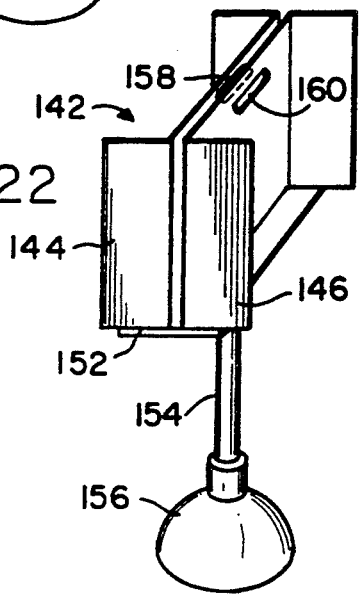
FIG. 22 is a top perspective view of the plunger and casing combination of FIGS. 20 and 21, showing the casing members in a fully raised, operative configuration.

As illustrated in FIGS. 20–22, yet another plunger and casing assembly 142 includes a pair of essentially identical U-shaped housing portions 144 and 146 each pivotably coupled by a respective pair of hinges 148 and 150 to a rectangular plate 152 in turn fastened to the end of a plunger handle member 154 opposite a cup-shaped rubber plunger element 156. Each of the housing portions 144 and 146 has an open side which faces outwardly in the fully opened configuration of FIG. 22 and inwardly in the closed configuration of FIG. 20. In addition, each housing portion 144 and 146 includes a second open side which faces away from plunger element 156 in the operative configuration (FIG. 22). Each housing portion 144 and 146 is provided with an elongate essentially oval aperture 158 and 160 which together enable a user to grib the assembly in its fully opened, operative configuration (FIG. 22).

Figure 23:
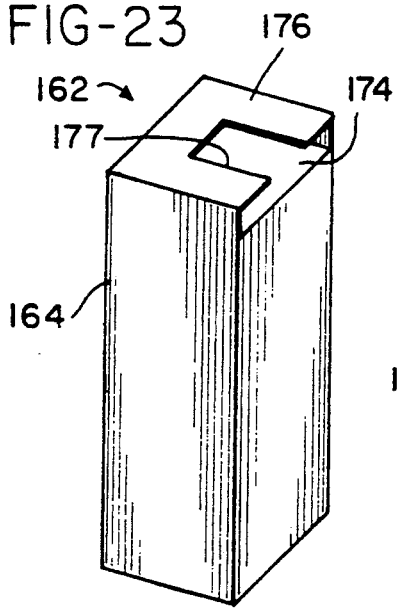
FIG. 23 is a top perspective view of an additional plunger and casing combination, showing the casing in a closed configuration.
Figure 29:
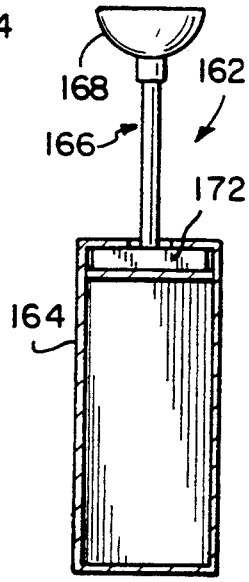
FIG. 29 is a side view of the plunger and casing combination of FIGS. 23 and 24 in the use configuration of FIG. 28.
Figure 24:
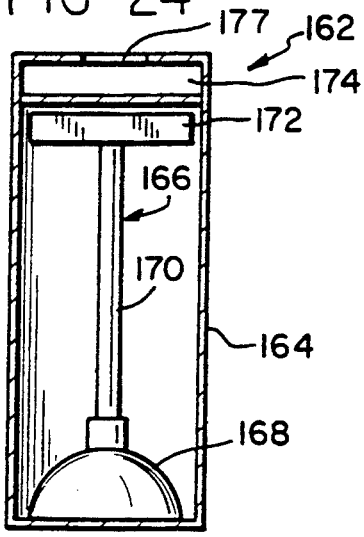
FIG. 24 is a vertical cross-sectional view of the plunger and casing combination of FIG. 23, showing a plunger inside the casing.
Figure 25:
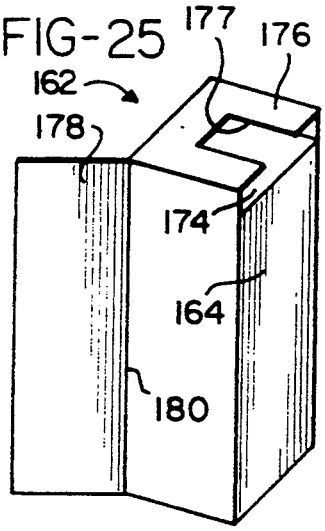
FIGS. 25, 26 and 27 are top perspective views showing the plunger and casing combination of FIGS. 23 and 24 with three alternative casing doors.
Figure 26:
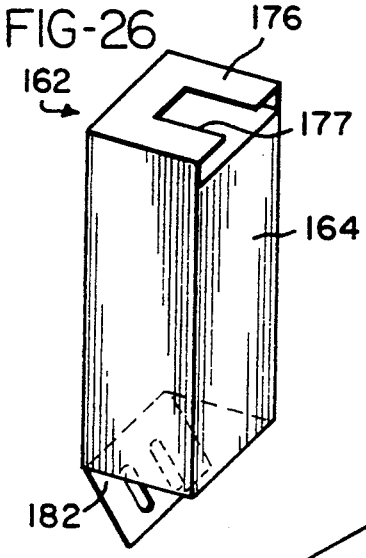
Figure 27:
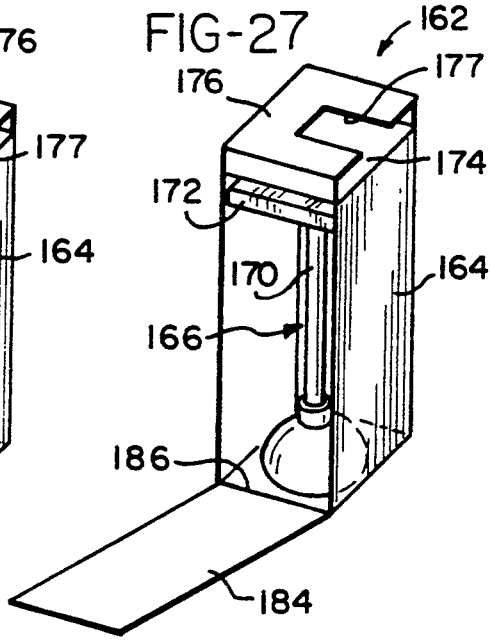
Figure 28:
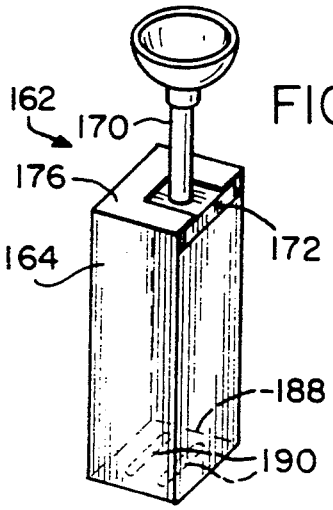
FIG. 28 is a top perspective view of the plunger and casing combination of FIGS. 23 and 24, showing the plunger removed and attached to the casing, ready for use.

FIGS. 23 and 24 show another plunger and casing assembly 162 in a closed storage configuration. The assembly includes a box-like housing or casing 164 and a plunger 166 with a cup-shaped flexible head portion 168, an elongate handle 170 and a rectangular terminal flange 172 positioned at an end of handle 170 opposite head portion 168. At one end, housing 164 is provided with a flat chamber 174 for receiving flange 172, as illustrated in FIGS. 28 and 29. An end wall 176 is provided with a slot 177 traversed by handle 170 in the operative configuration of the plunger and casing assembly. Housing 164 may be accessed through a side door 178 pivotably attached to the main body of the housing along a longitudinal joint 180 (FIG. 25), a pivotably attached bottom door 182 (FIG. 26), or a side door 184 pivotably attached to the main body of the housing along a transverse joint 186 (FIG. 27). In an end wall 188 opposite chamber 174, housing 164 is provided with a pair of elongate apertures 190 serving to facilitate a grasping of the housing by a user.

Figure 30:
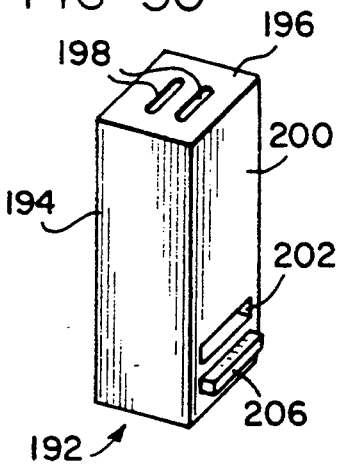
FIG. 30 is a top perspective view of a further plunger and casing combination, showing the casing with a closure plate in a closure position.
Figure 31:
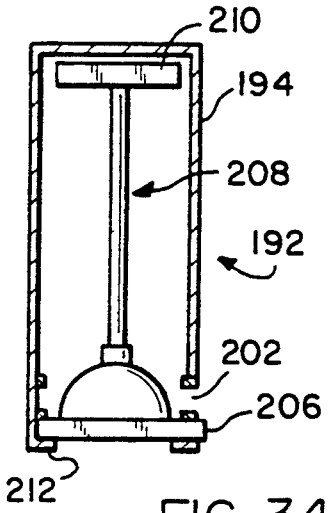
FIG. 31 is a vertical cross-sectional view of the plunger and casing combination of FIG. 30, showing a plunger inside the casing.
Figure 32:
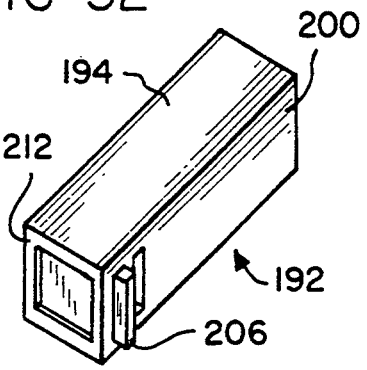
FIG. 32 is a bottom perspective view of the plunger and casing combination of FIGS. 30 and 31, showing the closure plate in the closure position.
Figure 33:
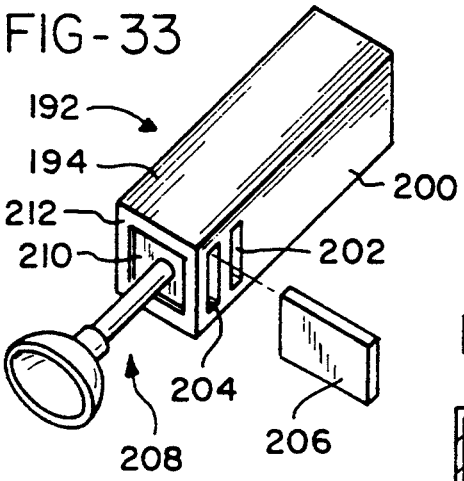
FIG. 33 is the same view as FIG. 32, with the closure plate removed and the plunger withdrawn from the casing.
Figure 34:
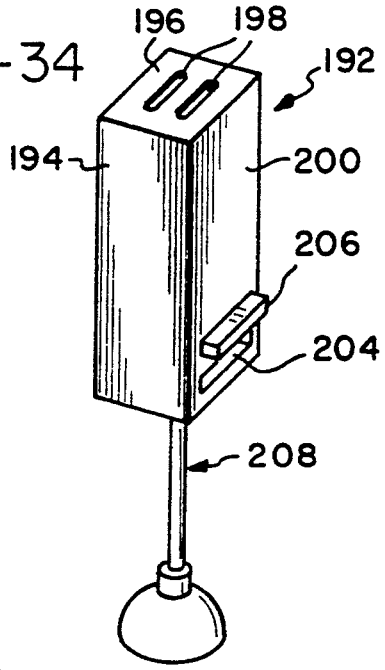
FIG. 34 is a top perspective view of the plunger and casing combination of FIGS. 30–33, showing the closure plate reinserted into the casing to hold the plunger in the extended use configuration.
Figure 35:
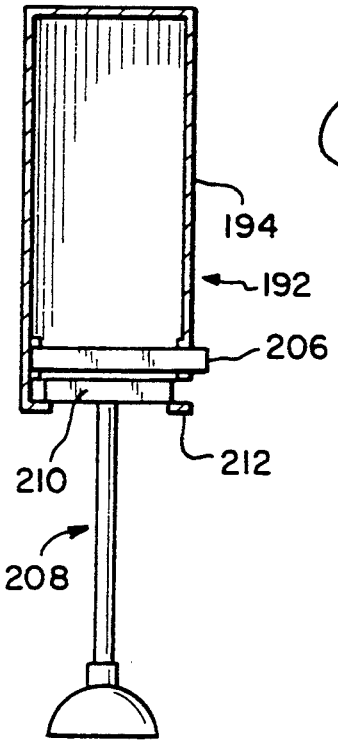
FIG. 35 is a vertical cross-sectional view of the plunger and casing combination of FIGS. 30–34, showing the plunger in the extended use configuration.
Figure 36:
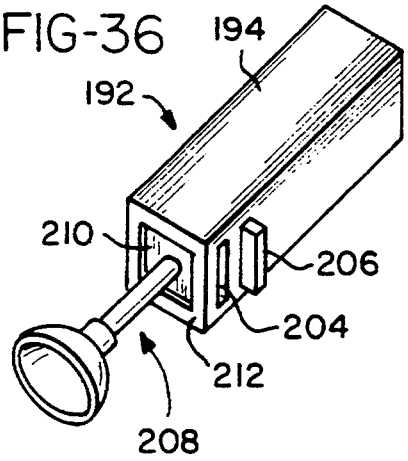
FIG. 36 is a bottom perspective view of the plunger and casing combination of FIGS. 30–35, showing the closure plate in the closure position and the plunger extended.

FIGS. 30 and 31 show yet another plunger and casing assembly 192 in a closed storage configuration. A housing 194 is provided in one end wall 196 with a hand grip formed by a pair of openings 198. In a side wall 200 at an end thereof opposite end wall 196, housing 194 is formed with a pair of slots 202 and 204. Slot 202 receives a plate 206 for closing a plunger 208 inside housing 194 in a storage configuration of the plunger and casing assembly 192 (see FIG. 31). Slot 204 receives the same plate 206 for locking or holding plunger 208 in an extended or withdrawn position relative to housing 194. In that position of the plunger, a flange 210 at the end of plunger 208 is clamped between plate 206 and a rim 212 of housing 194 opposite end wall 196 (see FIGS. 34–37). It is contemplated that slots 202 and 204 may be provided in different side walls of housing 194 and that a different plate or other member (not shown) may be used to lock plunger 208 in the operative position.

Figures 37, 38, 39, 40:
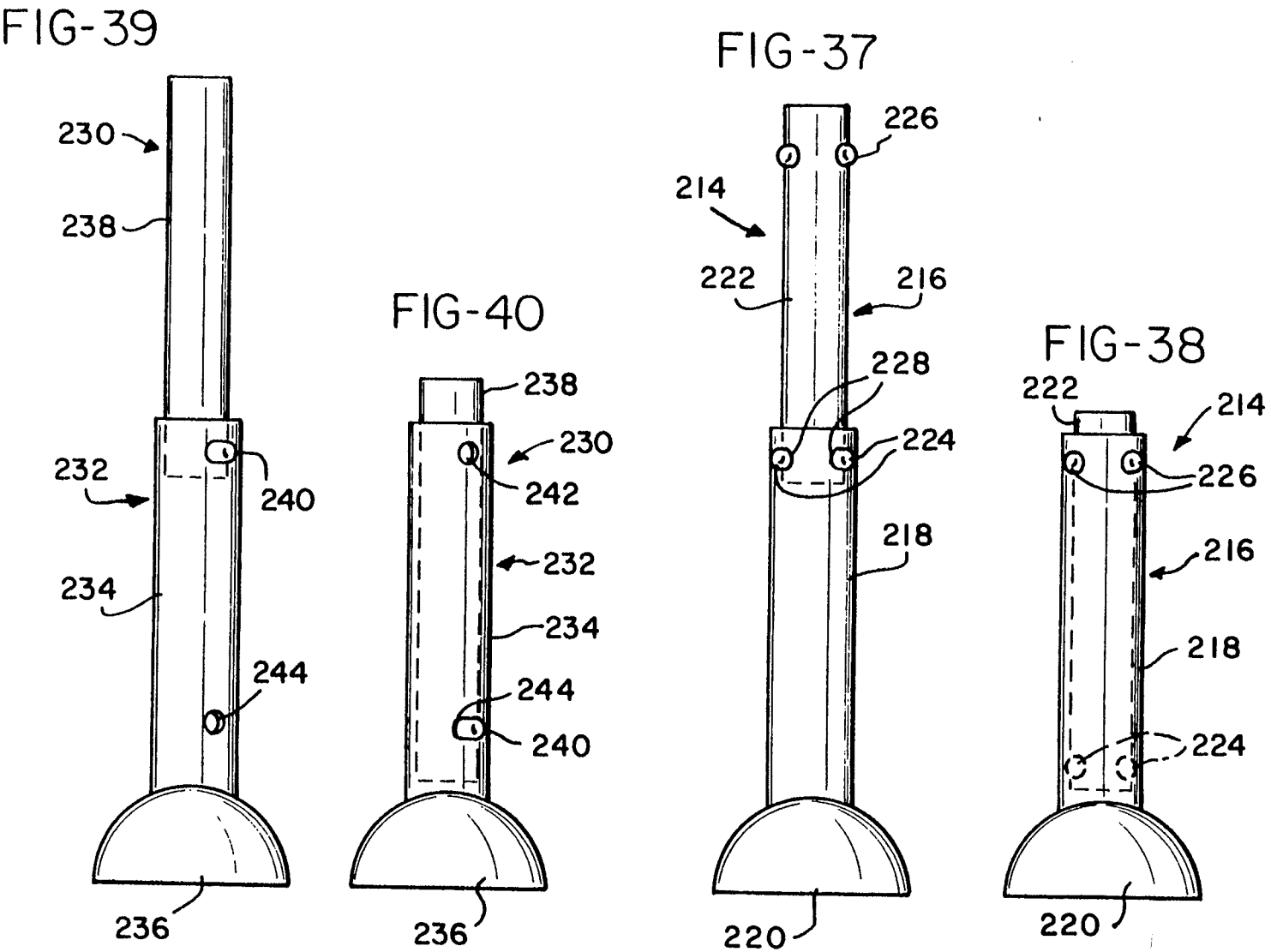
FIG. 37 is a front elevational view of a plunger in accordance with the present invention, showing a telescoping handle in an extended configuration.
FIG. 38 is a view similar to FIG. 37, showing the plunger of that drawing figure with its handle in a collapsed configuration.
FIG. 39 is a front elevational view of another plunger in accordance with the present invention, showing a telescoping handle in an extended configuration.
FIG. 40 is a view similar to FIG. 39, showing the plunger of that drawing figure with its handle in a collapsed configuration.

As depicted in FIGS. 37 and 38, a collapsible plunger 214 includes a handle 216 with a first tubular handle part 218 connected at one end to a cup-shaped flexible plunger head 220 and a second tubular handle part 222 telescopingly received inside the first tubular handle part. Inner handle part 222 is provided at one end with a first plurality of spring loaded buttons 224 and at an opposite end with an identical array of spring loaded buttons 226. Buttons 224 traverse respective openings 228 in an end of outer handle part 218 opposite plunger head 220 to lock the tubular handle parts 218 and 222 to one another in an extended use configuration. Similarly, buttons 226 cooperate with the same openings 228 to lock the tubular handle parts 218 and 222 to one another in a collapsed, storage configuration (FIG. 38).

As depicted in FIGS. 39 and 40, a further collapsible plunger 230 includes a handle 232 with a first tubular handle part 234 connected at one end to a cup-shaped flexible plunger head 236 and a second tubular handle part 238 telescopingly received inside the first tubular handle part. Inner handle part 238 is provided at one end with a spring loaded button 240, while outer handle part 234 is provided with a pair of apertures 242 and 244 at opposite ends for receiving button 240 in an extended, operative configuration and a collapsed, storage configuration, respectively.

Figure 41:
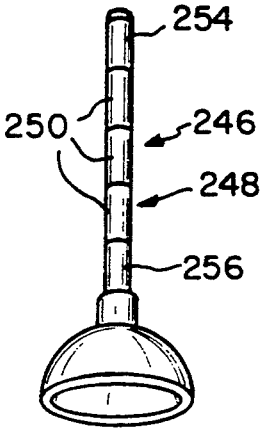
FIG. 41 is a front elevational view of yet another plunger, showing a collapsable handle in a linear operative configuration.
Figure 42:
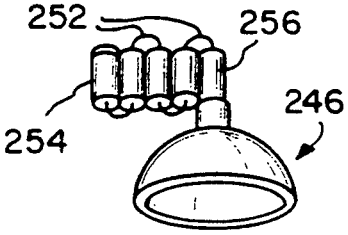
FIG. 42 is a view similar to FIG. 41, showing the plunger of that drawing figure with its handle in a collapsed storage configuration.
Figure 43:
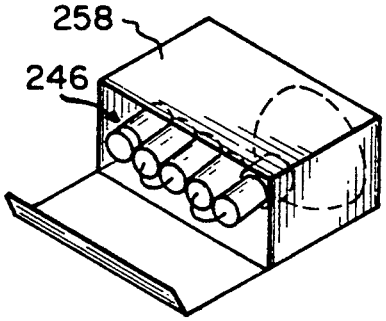
FIG. 43 is a perspective view of a plunger and casing combination including the plunger of FIGS. 41 and 42 in the collapsed configuration.

As shown in FIGS. 41–43, an additional collapsible plunger 246 includes a handle 248 comprising a plurality of hollow shaft members 250 connected to one another by a tensile cord 252 fastened at its opposite ends to outer shaft members 254 and 256. The shaft members are held in a linear operative configuration by the tensile cord 252. Upon a stetching of the cord, the shaft members 250 can be separated and placed side by side in a folded storage configuration (FIG. 42). FIG. 43 shows the collapsed plunger 246 in a storage box 258.

Figure 44:
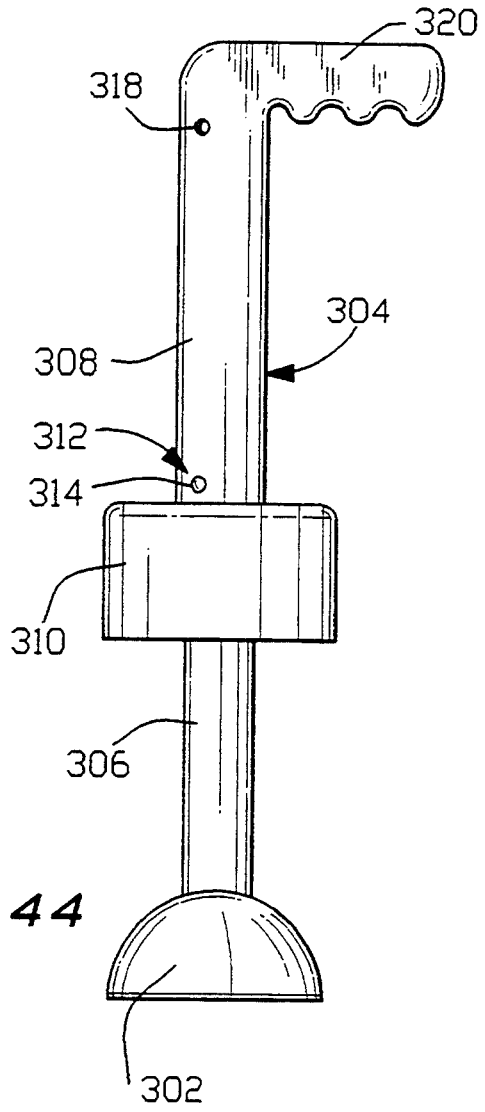
FIG. 44 is an elevational view of another plunger assembly in accordance with the present invention, showing a handle in an extended, use configuration.
Figure 45:
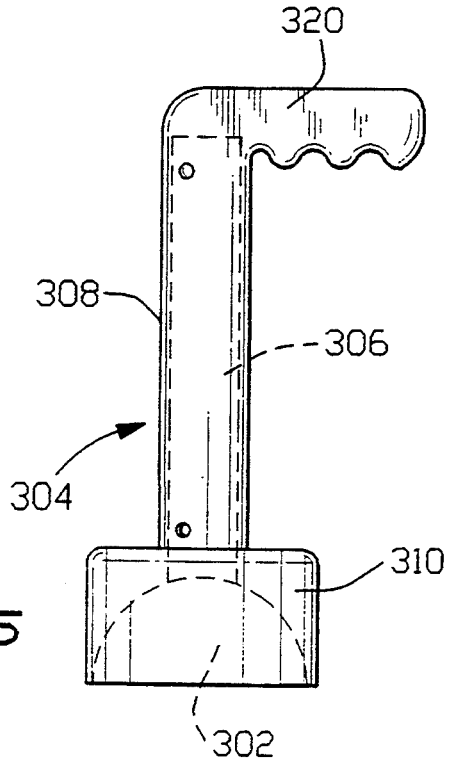
FIG. 45 is an elevational view the plunger assembly of FIG. 44, showing the handle in a collapsed storage configuration.

As illustrated in FIGS. 44 and 45, a household implement comprises a cup-shaped plunger member 302 contactable with a household surface. A handle 304 of the implement includes an inner tubular handle part 306 connected at one end to plunger member 302 and an outer tubular handle part 308 into which inner handle part 306 is matingly or telescopingly inserted. A hollow casing member 310 is attached to outer tubular handle part 308 at the first end thereof. Casing member 310 is larger than plunger member 302, whereby casing member 310 substantially surrounds plunger member 302 upon movement of outer tubular handle part 308 over inner tubular handle part 306 and towards plunger member 302. A locking mechanism 312 including a spring-loaded latch element 314 is connected to at least one of the handle parts 306 and 308, e.g., inner handle part 306, for locking the handle parts to one another in an extended, operative configuration of the implement (FIG. 44). Locking mechanism 312 includes an aperture 316 in a side wall of outer tubular handle part 308 proximate to casing member 310. Spring-loaded latch element 314 is inserted through aperture 316, as shown in FIG. 44 to maintain the implement in the extended, operative configuration.

As shown in FIGS. 44 and 45, outer tubular handle part 308 is provided with at least one additional aperture 318 at a second end of the outer tubular handle part opposite the hollow casing member 310. Spring-loaded latch element 314 is insertable through additional aperture 318 upon a collapsing of outer tubular handle part 308 over inner tubular handle part 306 and a covering of plunger member 302 with casing member 310. Additional aperture 318 in outer tubular handle part 308 thus cooperates with spring-loaded latch element 314 to lock the handle 304 in a collapsed storage configuration depicted in FIG. 45.

Hollow casing member 310 includes an opening (not illustrated) on an underside, i.e., a side opposite outer tubular handle part 308, for receiving cup-shaped plunger member 302 in the storage configuration of the implement. In the storage configuration, plunger member 302 may rest on a floor or other horizontal surface. Upon lifting the implement from the horizontal surface by grasping outer tubular handle part 308, inner tubular handle part 306 is shifted out of outer tubular handle part 308. This may be accomplished with the aid of gravity by simply pressing spring-loaded latch element 314 through aperture 318. Inner tubular handle part 306 and plunger member 302 then fall out from outer tubular handle part 308 and casing member 310. Tubular handle parts 306 and 308 are locked to one another in the extended, operative configuration of the implement by aligning latch element 314 with aperture 316 so that the latch element pops through the aperture. Casing member 310 is thus spaced from plunger member 302 during subsequent manipulation of the plunger implement via a handgrip 320 at the end of outer tubular handle part 308 opposite casing member 310. After use of the implement, the inner tubular handle part 306 is released from outer tubular handle part 308 by unlocking latch element 314 from aperture 316 and moving inner tubular handle part 306 back into outer tubular handle part 308 so that casing member 310 surrounds plunger member 302. The implement is then placed back into storage on a floor or other surface so that plunger member 302 is in contact with that surface and surrounded by casing member 310.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A household implement comprising:

a cup-shaped plunger member contactable with a household surface;

a collapsible handle attached to said plunger member, said handle having an outer tubular handle part and an inner tubular handle part telescopingly inserted therein, said inner tubular handle part being fixed at one end to said plunger member, an opposite end of said inner tubular handle part being disposed inside a first end of said outer tubular handle part, said first end of said outer tubular handle part being provided with an aperture;

a hollow casing member attached to said outer tubular handle part at said first end thereof, said hollow casing member being larger than said plunger member, whereby said casing member substantially surrounds said plunger member upon movement of said outer tubular handle part over said first tubular handle part towards said plunger member; and locking means for locking said collapsible handle in an extended, operative configuration, said locking means including at least one spring-loaded latch element provided on said inner tubular handle part proximately to said opposite end and spaced from said plunger member, said latch element being insertable through said aperture to lock said inner tubular handle part to said outer tubular handle part in said extended, operative configuration.

2. The implement defined in claim 1 wherein at least one additional aperture is provided in said outer tubular handle part at a second end thereof opposite said first end, said spring-loaded latch element being insertable through said additional aperture upon a collapsing of said outer tubular handle part over said inner tubular handle part and a covering of said plunger member with said casing member.

3. A household implement comprising:

a cup-shaped plunger member contactable with a household surface;

a first tubular handle part connected at one end to said plunger member;

a second tubular handle part, said first tubular handle part being matingly enclosed in said second tubular handle part by being inserted in a first end of said second tubular handle part in a storage configuration;

a hollow casing member attached to said second tubular handle part at said first end thereof, said hollow casing member being larger than said plunger member, whereby said casing member substantially surrounds said plunger member upon movement of said outer tubular handle part over said first tubular handle part towards said plunger member; and locking means for cooperation between another end of said first tubular handle part and said first end of said second tubular handle part for locking said first and said second tubular handle part to one another in an extended, operative configuration of the implement.

4. The implement defined in claim 3 wherein said locking means includes an aperture in a side wall of said second tubular handle part proximate to said first end, said locking means further including, one said first tubular handle part, at least one spring-loaded latch element insertable through said aperture in said extended, operative configuration of the implement.

5. The implement defined in claim 4 wherein said second tubular handle part is provided at opposite ends with apertures for cooperating with said spring loaded latch element to lock said second tubular handle part to said first tubular handle part alternatively in said extended, operative configuration and a collapsed storage configuration.

6. A method for unstopping a household drain, comprising the steps of:

providing a household implement having a plunger member with a telescoping handle attached thereto, an inner tubular handle part of said telescoping handle being slidably inserted into an outer tubular handle part of said telescoping handle in a storage configuration of the implement;

removing the implement from storage;

upon removal of the implement from storage, shifting said inner tubular handle part out of said outer tubular handle part;

upon shifting of said inner tubular handle part relative to said outer tubular handle part, locking said inner tubular handle part to said outer tubular handle part in an extended configuration of said inner tubular handle part relative to said outer tubular handle part;

manipulating the implement via said telescoping handle to unstop a drain;

upon unstopping of said drain, releasing said inner tubular handle part from said outer tubular handle part;

upon completion of said step of releasing, moving said inner tubular handle part back into said outer tubular handle part;

wherein said inner tubular part is connected to said plunger member and said outer tubular handle part is provided with a hollow casing member which covers said plunger member in said storage configuration, said step of shifting including the step of removing said casing member from around said plunger member, thereby uncovering said plunger member by virtue solely of said step of shifting.

7. A method for unstopping a household drain, comprising the steps of:

providing a household implement having a plunger member with an inner tubular member of a telescoping handle attached thereto, said inner tubular handle part being slidably inserted into an outer tubular handle part of said telescoping handle in a storage configuration of the implement, said plunger member being covered in said storage configuration by a hollow casing member attached to an end of said outer tubular handle part, said plunger member resting on a horizontal surface in said storage configuration;

lifting the implement from said horizontal surface by grasping said outer tubular handle part;

upon lifting of the implement from said horizontal storage, shifting said inner tubular handle part out of said outer tubular handle part;

upon shifting of said inner tubular handle part relative to said outer tubular handle part, locking said inner tubular handle part to said outer tubular handle part in an extended configuration of said inner tubular handle part relative to said outer tubular handle part so that said casing member is spaced from said plunger member;

manipulating the implement via said telescoping handle to unstop a drain;

upon unstopping of said drain, releasing said inner tubular handle part from said outer tubular handle part;

upon completion of said step of releasing, moving said inner tubular handle part back into said outer tubular handle part so that said casing member surrounds said plunger member; and replacing said implement so that said plunger member is in contact with a floor surface and surrounded by said casing member.

8. The method defined in claim 7 wherein said step of locking includes the step of inserting a latch element in one of said inner tubular handle part and said outer tubular handle part through an aperture in the other of said inner tubular handle part and said outer tubular handle part.

9. The method defined in claim 8 wherein said latch element is spring loaded, said step of releasing including the step of pressing said latch element through said aperture in opposition to a biasing spring force.

10. The method defined in claim 7, further comprising the step of also locking said inner tubular handle part to said outer tubular handle part upon completion of said step of moving.

11. The method defined in claim 10 wherein said step of also locking includes the step of inserting a latch element in one of said inner tubular handle part and said outer tubular handle part through an aperture in the other of said inner tubular handle part and said outer tubular handle part.

12. The method defined in claim 7, further comprising the step of returning the implement to storage upon completion of said step of moving.

* * * * *

UNITED STATES PATENT AND TRADEMARK OFFICE

CERTIFICATE OF CORRECTION

PATENT NO. : 5,335,374

DATED : August 9, 1994

INVENTOR(S) : Marilyn M. Wilk and Peter J. Wilk

It is certified that error appears in the above-indentified patent and that said Letters Patent is hereby corrected as shown below:

In the Abstract line 16, change "first" to --inner--.

Column 2, line 2, change "first" to --inner--; line 39, change "outer" to --second--; line 67, change "drain" to --part--.

Column 5, line 11, change "a-top" to --a top--.

Column 6, line 61, change "94" to --95--.

Column 8, line 3, change "202" (second occurrence) to --204--; line 6, change "204" to --202--.

Column 9, line 18, change "a" to --the--.

Column 10, line 11, claim 1, change "first" to --inner--; line 45, claim 3, change "outer" to --second--; line 56, claim 4, change "one" to --on--.

Signed and Sealed this

Twenty-third Day of May, 1995

*Attest:*

BRUCE LEHMAN

*Attesting Officer*

*Commissioner of Patents and Trademarks*